US012201192B2

(12) United States Patent
Gao et al.

(10) Patent No.: US 12,201,192 B2
(45) Date of Patent: Jan. 21, 2025

(54) CONNECTING BUCKLE WITH SAFETY SWITCH

(71) Applicant: Foshan Tuorun Precision Hardware Technology Co., Ltd, Guangdong (CN)

(72) Inventors: Maoyang Gao, Guangdong (CN); Yong He, Guangdong (CN)

(73) Assignee: Foshan Tuorun Precision Hardware Technology Co., Ltd, Foshan (CN)

( * ) Notice: Subject to any disclaimer, the term of this patent is extended or adjusted under 35 U.S.C. 154(b) by 14 days.

(21) Appl. No.: 18/139,913

(22) Filed: Apr. 26, 2023

(65) Prior Publication Data

US 2024/0358123 A1 Oct. 31, 2024

(51) Int. Cl.
*A44B 11/25* (2006.01)

(52) U.S. Cl.
CPC ..... *A44B 11/2573* (2013.01)

(58) Field of Classification Search
CPC ..... A44B 11/2511; A44B 11/2542; A44B 11/2573; A44B 11/12
See application file for complete search history.

(56) References Cited

U.S. PATENT DOCUMENTS

| | | | | |
|---|---|---|---|---|
| 2,933,795 A * | 4/1960 | Meeker | A44B 11/2526 | 24/647 |
| 5,113,556 A * | 5/1992 | Murai | A44B 11/263 | 24/615 |
| 5,311,649 A * | 5/1994 | Suh | A44B 11/266 | 24/616 |
| 11,622,606 B1 * | 4/2023 | Lin | A44B 11/22 | 24/303 |
| 2007/0079486 A1 * | 4/2007 | Paik | A44B 11/263 | 24/615 |

* cited by examiner

*Primary Examiner* — Robert Sandy

(57) ABSTRACT

This application discloses a connecting buckle with a safety switch. The connecting buckle includes a male connecting piece, a female connecting piece and a buckling apparatus; the buckling apparatus includes a buckling piece, the buckling piece is arranged in match with a sliding frame arranged on the male connecting piece, a rotating shaft is arranged on the buckling piece; the rotating shaft and the rotating holes formed on the sliding frame are correspondingly arranged, a clamping part corresponding to the buckling hole is arranged at one end of the buckling piece, an upward supporting spring is arranged between the other end of the buckling piece and the sliding frame, and a pressure stopping apparatus is also arranged on the buckling apparatus. The connecting buckle with the safety switch has the advantages that the structure is simple, accidental loosening of the connecting buckle is completely avoided, and the universality is wide.

10 Claims, 3 Drawing Sheets

CONNECTING BUCKLE WITH SAFETY SWITCH

TECHNICAL FIELD

This application relates to the technical field of connecting buckles, and particularly relates to a connecting buckle with a safety switch.

BACKGROUND

Connecting buckles are widely applied to connecting positions of a waistband, a backpack belt and the like, and are used for connecting and fixing two ends of a cloth belt or the ends of two canvas belts, and meanwhile achieve a decoration effect. An existing connecting buckle with a safety switch generally adopts the lever principle, that is, a spring at one end of a buckle is pressed to unlock the other end of the buckle, and therefore mutual separation of the connecting buckle is achieved. In order to prevent a user from pressing the spring end of the buckle to unlock the connecting buckle by mistake, the spring is generally arranged at a position close to a fulcrum of a lever, and the user needs to apply a larger force to press the spring end of the buckle to unlock the connecting buckle. However, the phenomenon that the user presses the spring end of the buckle to unlock the connecting buckle by mistake cannot be completely avoided.

Therefore, a connecting buckle with a safety switch is provided.

SUMMARY

An objective of this application is to provide a connecting buckle with a safety switch, which can completely avoid a phenomenon of accidental unlocking of the connecting buckle.

In order to achieve the above objective, this application adopts the following technical solution:

a connecting buckle with a safety switch includes a male connecting piece, a female connecting piece and a buckling apparatus; a male connecting rod is arranged at one end of the male connecting piece, a sliding frame is arranged at the other end of the male connecting piece, and rotating holes are arranged on two sides of the sliding frame; a female connecting rod is arranged at one end of the female connecting piece, a sliding groove corresponding to the sliding frame is arranged at the other end of the female connecting piece, and a buckling hole is arranged on the sliding groove; and the buckling apparatus includes a buckling piece arranged on the sliding frame, the buckling piece is arranged in match with the sliding frame, a convex ring is arranged in the middle of the buckling piece, an inner hole of the convex ring and the rotating holes are correspondingly arranged, a rotating shaft is arranged in the convex ring, two ends of the rotating shaft are arranged in match with the rotating holes, a clamping part corresponding to the buckling hole is arranged at one end of the buckling piece, an upward supporting spring is arranged between the other end of the buckling piece and the sliding frame, a strip-shaped shifting slotted hole is arranged at one end, close to the upward supporting spring, of the buckling piece; a pressure stopping apparatus is also arranged on the buckling apparatus, the pressure stopping apparatus includes a shifting block arranged on the buckling piece, a shifting rod arranged in match with the shifting slotted hole is arranged at the lower end of the shifting block, a pressing block is arranged at the lower end of the shifting rod, and a pressure stopping convex block corresponding to the pressing block is arranged on the sliding frame.

Furthermore, a convex hook corresponding to the clamping part is arranged in the sliding groove, and the convex hook is arranged on the side, away from the female connecting rod, of the buckling hole.

Furthermore, a stop block is arranged on the inner side, close to the clamping part, of the sliding frame, and the stop block is arranged below the buckling piece.

Furthermore, the distance between the upward supporting spring and the rotating shaft is less than the distance between the clamping part and the rotating shaft.

Furthermore, the male connecting rod comprises an outer connecting rod and an inner connecting rod which are arranged in parallel, movable grooves perpendicular to the inner connecting rod are arranged on two sides of the male connecting piece, and two ends of the inner connecting rod are arranged in match with the movable grooves.

Furthermore, flanges are arranged on two sides of the sliding frame, and guide grooves corresponding to the flanges are arranged on two sides of the sliding groove.

Furthermore, the rotating shaft comprises clamping ends at two ends and a fast-mounting spring arranged between the two clamping ends.

Furthermore, an upper spring fixing groove in match with the upward supporting spring is arranged at the lower end of the buckling piece, a lower spring fixing groove in match with the upward supporting spring is arranged on the sliding frame, and the upper spring fixing groove and the lower spring fixing groove are correspondingly arranged.

Furthermore, an upper fixing base in match with the upward supporting spring is arranged in the upper spring fixing groove, and a lower fixing base in match with the upward supporting spring is arranged in the lower spring fixing groove.

Furthermore, anti-skid lines are arranged at the top end of the shifting block.

According to this application, the connecting buckle includes the male connecting piece, the female connecting piece and the buckling apparatus; the male connecting rod is arranged at one end of the male connecting piece, the sliding frame is arranged at the other end of the male connecting piece, and the rotating holes are arranged on the two sides of the sliding frame; the female connecting rod is arranged at one end of the female connecting piece, the sliding groove corresponding to the sliding frame is arranged at the other end of the female connecting piece, and the buckling hole is arranged on the sliding groove; the buckling apparatus includes the buckling piece arranged on the sliding frame, the buckling piece is arranged in match with the sliding frame, the rotating shaft is arranged on the buckling piece, the rotating shaft and the rotating holes are correspondingly arranged, the clamping part corresponding to the buckling hole is arranged at one end of the buckling piece, the upward supporting spring is arranged between the other end of the buckling piece and the sliding frame, and the pressure stopping apparatus is also arranged on the buckling apparatus. The connecting buckle with the safety switch has the advantages that the structure is simple, accidental loosening of the connecting buckle is completely avoided, and the universality is wide.

DETAILED DESCRIPTION

This application provides a connecting buckle with a safety switch. In order to make the objective, technical solution and effect of this application clearer and more definite, this application will be further described in detail with reference to the accompanying drawings and embodiments. It is to be understood that the specific embodiments described herein are only used for explaining this application, but not to limit this application.

Figure 1:
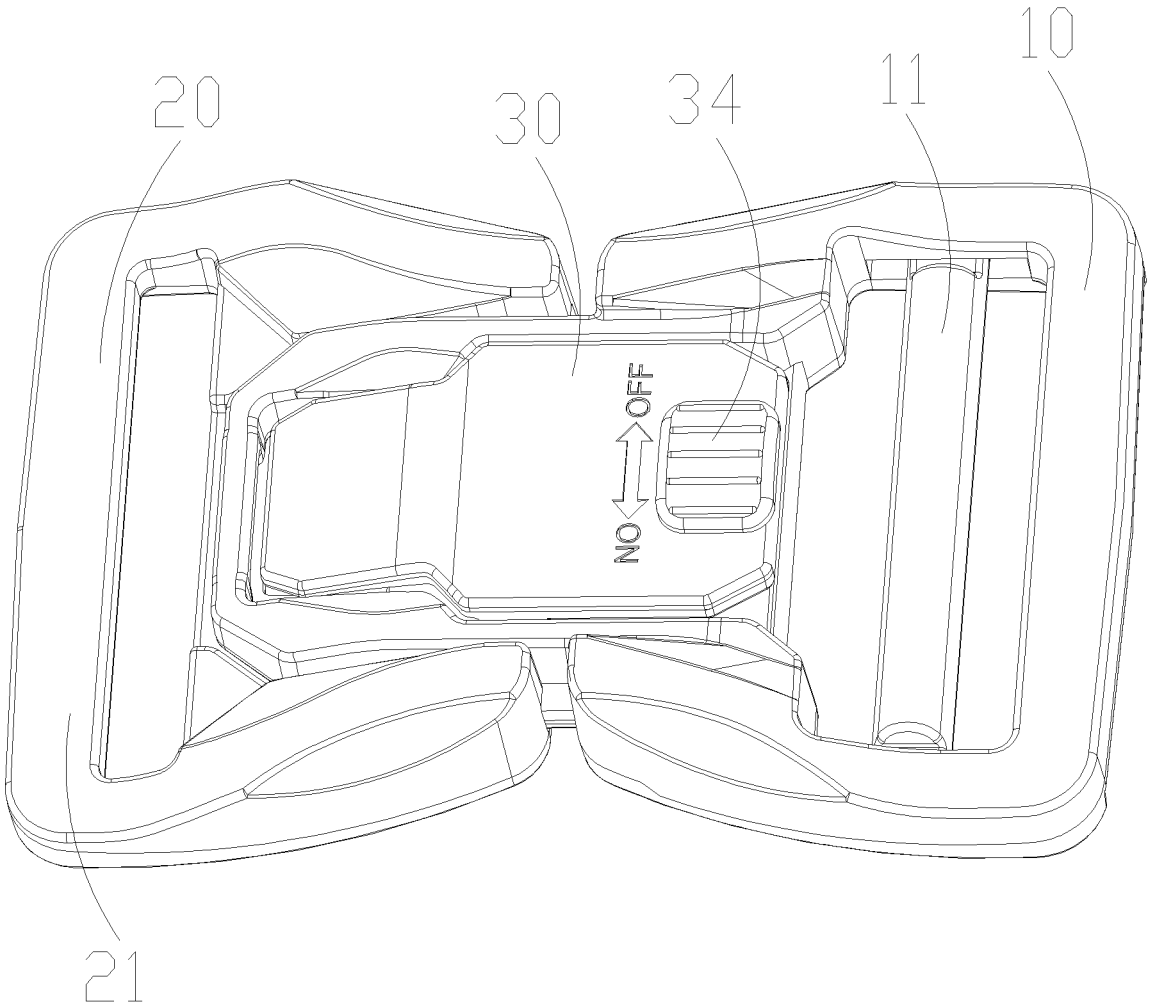
FIG. 1 is a three-dimensional structure schematic diagram of a connecting buckle with a safety switch according to this application.
Figure 2:
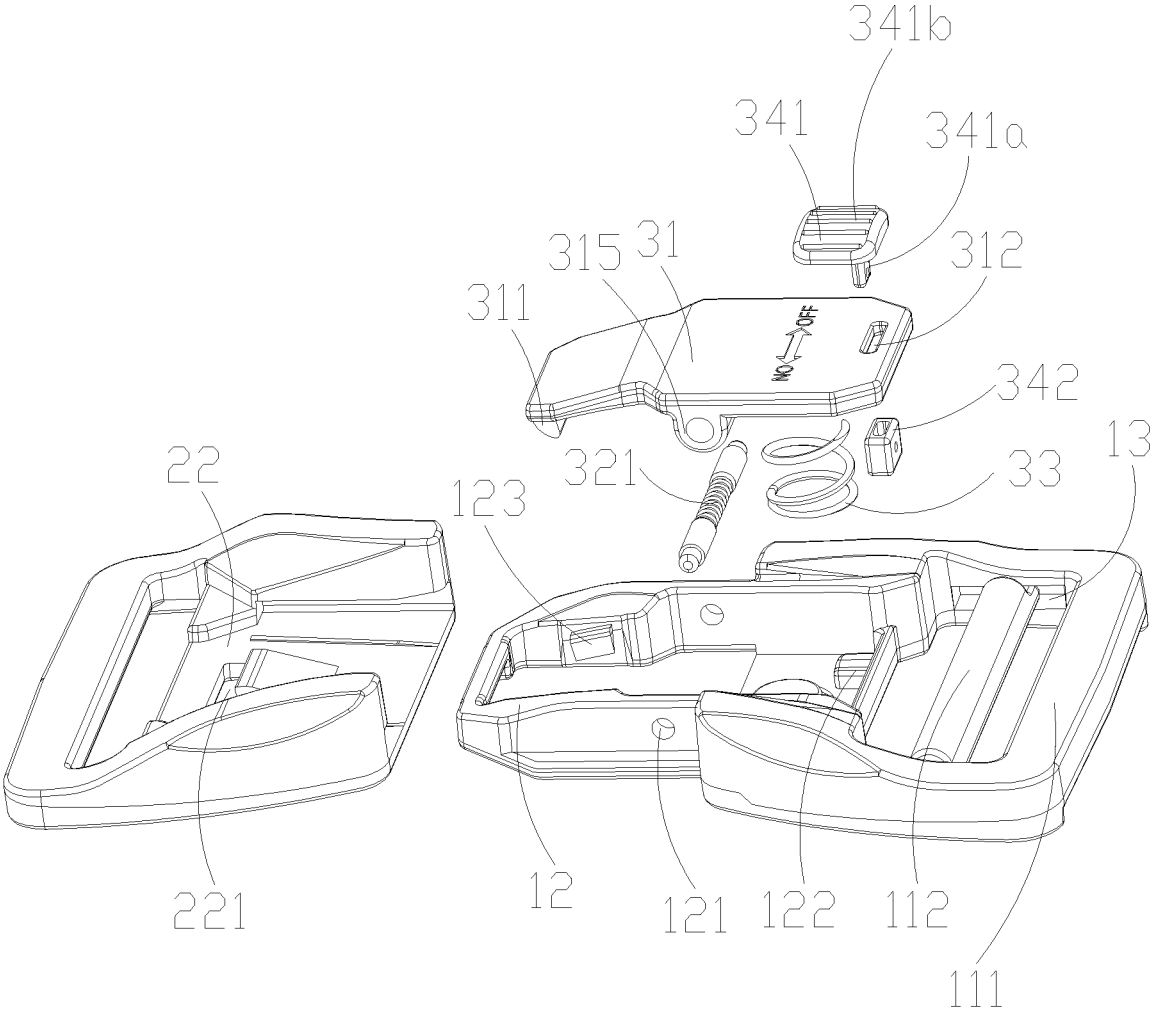
FIG. 2 is an explosion diagram 1 of a connecting buckle with a safety switch according to this application.
Figure 3:
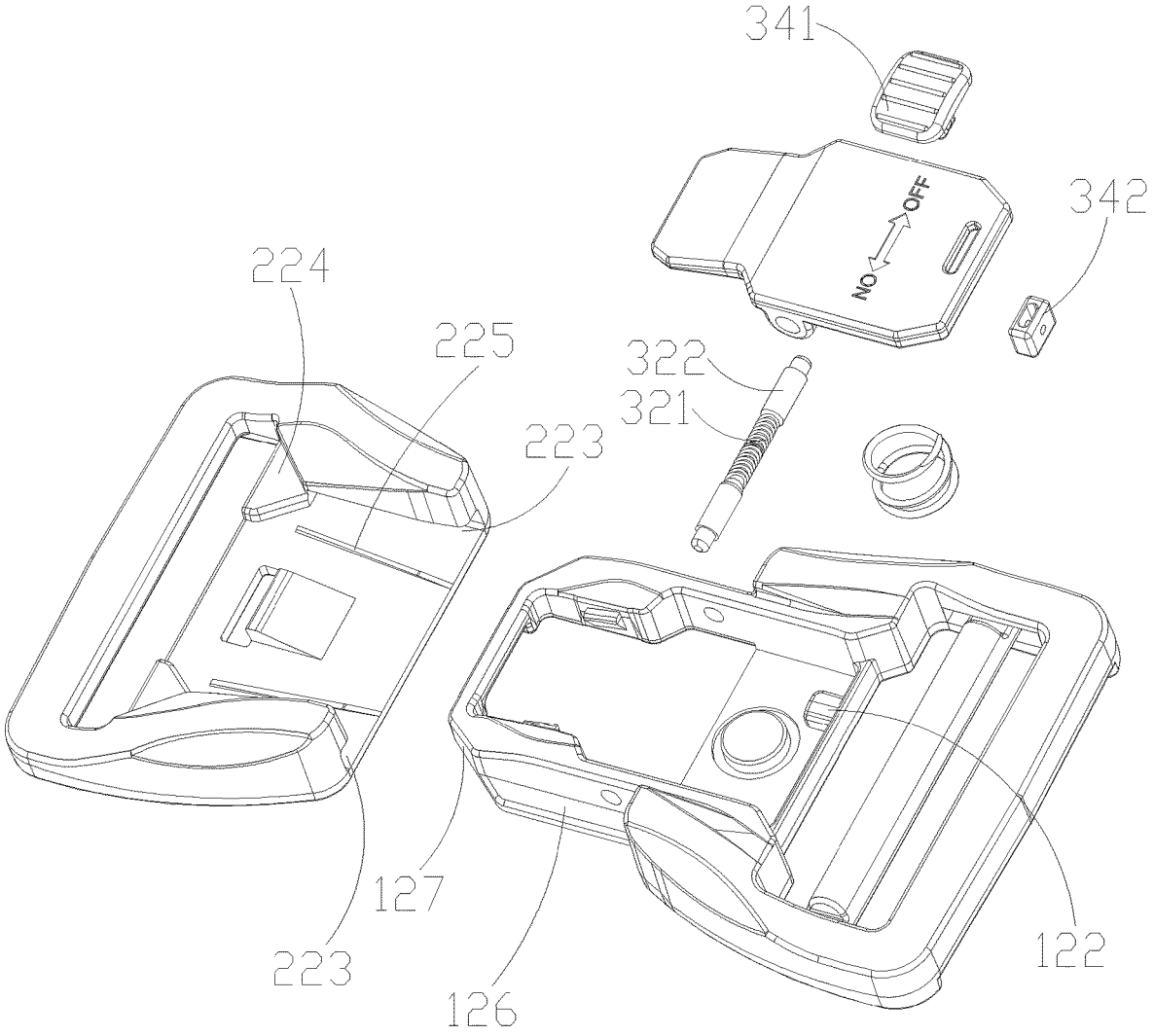
FIG. 3 is an explosion diagram 2 of a connecting buckle with a safety switch according to this application.
Figure 4:
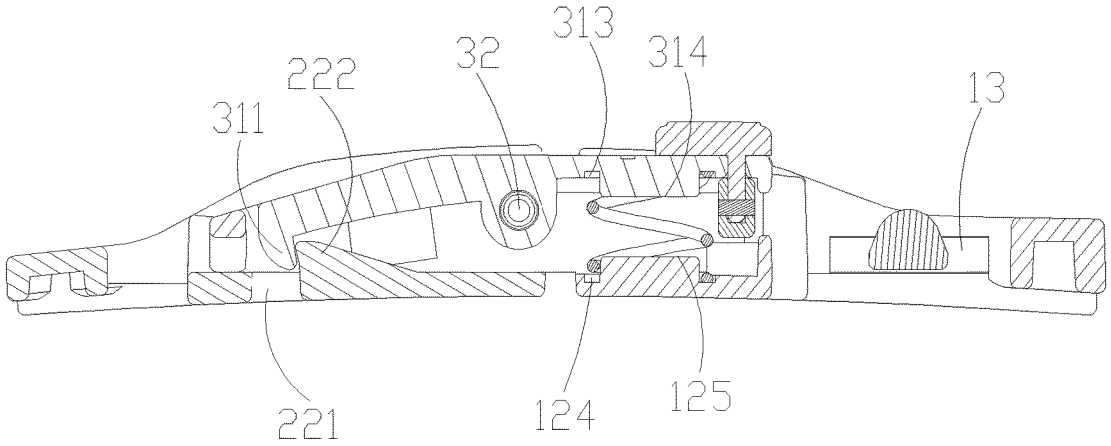
FIG. 4 is a main view profile of a connecting buckle with a safety switch according to this application.

This application provides a connecting buckle with a safety switch, and the structure of the connecting buckle with the safety switch is shown in FIGS. 1-4. The connecting buckle with the safety switch includes a male connecting piece 10, a female connecting piece 20 and a buckling apparatus 30; a male connecting rod 11 is arranged at one end of the male connecting piece 10, and the male connecting rod 11 is configured to be fixedly connected to one end of a waistband or a cloth belt. A sliding frame 12 is arranged at the other end of the male connecting piece 10, and rotating holes 121 are arranged on two sides of the sliding frame 12; a female connecting rod 21 is arranged at one end of the female connecting piece 20, and the female connecting rod 21 is configured to be fixedly connected to the other end of the waistband or another cloth belt. A sliding groove 22 corresponding to the sliding frame 12 is arranged at the other end of the female connecting piece 20, and a buckling hole 221 is arranged on the sliding groove 22.

The buckling apparatus 30 includes a buckling piece 31 arranged on the sliding frame 12, the buckling piece 31 is arranged in match with the sliding frame 12, a convex ring 315 is arranged in the middle of the buckling piece 31, an inner hole of the convex ring 315 and the rotating holes 121 are correspondingly arranged, a rotating shaft 32 is arranged in the convex ring 315, two ends of the rotating shaft 32 are arranged in match with the rotating holes 121, the diameter of the inner hole of the convex ring 315 can be greater than the diameter of the rotating holes 121, the two ends of the rotating shaft 32 are arranged to be step shafts, and therefore the rotating shaft 32 can be positioned in a transverse position. A clamping part 311 corresponding to the buckling hole 221 is arranged at one end of the buckling piece 31, an upward supporting spring 33 is arranged between the other end of the buckling piece 31 and the sliding frame 12, and a strip-shaped shifting slotted hole 312 is arranged at the end, close to the upward supporting spring 33, of the buckling piece 31. In this embodiment, the upward supporting spring 33 is arranged between the convex ring 315 and the shifting slotted hole 312. A pressure stopping apparatus 34 is also arranged on the buckling apparatus 30, and the pressure stopping apparatus 34 includes a shifting block 341 arranged on the buckling piece 31, a shifting rod 341*a* in match with the shifting slotted hole 312 is arranged at the lower end of the shifting block 341, a pressing block 342 is arranged at the lower end of the shifting rod 341*a*, and a pressure stopping convex block 122 corresponding to the pressing block 342 is arranged on the sliding frame 12.

The sliding frame 12 of the male connecting piece 10 can relatively slide in the sliding groove 22 of the female connecting piece 20, when the clamping part 311 of the buckling piece 31 on the sliding frame 12 and the buckling hole 221 in the sliding groove 22 slide to a clamping state, the upward supporting spring 33 supports one end of the buckling piece 31 above the upward supporting spring upwards, and the clamping part 311 of the buckling piece 31 is naturally and downwards clamped to the buckling hole 221 tightly. At the moment, the shifting block 341 is located at an "NO" gear, and no obstacle exists below the pressing block 342. The shifting block 341 is shifted to an "OFF" gear, thus the pressing block 342 is located right above the pressure stopping convex block 122, and the pressing block 342 cannot move toward the sliding frame 12; the end, making contact with the upward supporting spring 33, of the buckling piece 31 cannot move toward the sliding frame 12, and the clamping part 311 of the buckling piece 31 is clamped to the buckling hole 221 tightly all the time, that is, the safety switch is added to the connecting buckle. When opening the connecting buckle, the shifting block 341 needs to be shifted to the "NO" gear firstly, otherwise, even if a large external force is applied on the end, making contact with the upward supporting spring 33, of the buckling piece 31, the male connecting piece 10 and the female connecting piece 20 are still connected tightly through the pressure stopping apparatus 34, and the phenomenon that the connecting buckle is loosened accidentally is avoided.

Specifically, a convex hook 222 corresponding to the clamping part 311 is arranged in the sliding groove 22, and the convex hook 222 is arranged on the side, away from the female connecting rod 21, of the buckling hole 221. One side of the buckling piece 31 is served as an outer side, and a user presses the end, making contact with the upward supporting spring 33, of the buckling piece 31 so that the clamping part 311 can move toward the outer side. One side of the buckling hole 221 usually makes contact with the user, and the clamping part 311 and the convex hook 222 are correspondingly arranged, thus the clamping part 311 cannot protrude out of the buckling hole 221 when being clamped, the clamping part 311 cannot make contact with the user, and as a result, good experience feeling of the user is improved.

Specifically, a stop block 123 is arranged on the inner side, close to the clamping part 311, of the sliding frame 12, and the stop block 123 is arranged below the buckling piece 31. It is guaranteed that the clamping part 311 cannot make contact with the user when being clamped downwards, and thus the good experience feeling of the user is further improved.

Specifically, the distance between the upward supporting spring 33 and the rotating shaft 32 is less than the distance between the clamping part 311 and the rotating shaft 32. When unlocking the connecting buckle, the male connecting piece 10 and the female connecting piece 20 can be separated only through a larger acting force, thus the second anti-accidental unlocking safety is increased, and as a result, the phenomenon that the connecting buckle is accidentally loosened is further avoided.

Specifically, the male connecting rod 11 includes an outer connecting rod 111 and an inner connecting rod 112 which are arranged in parallel. The outer connecting rod 111 and the inner connecting rod 112 can facilitate the user to adjust the use length of the waistband or the cloth belt, and thus the universality of the connecting buckle is improved. Movable grooves 13 perpendicular to the inner connecting rod 112 are arranged on two sides of the male connecting piece 10, and two ends of the inner connecting rod 112 are arranged in match with the movable grooves 13. The inner connecting rod 112 can slide in the movable grooves 13, so that the length of the waistband or the cloth belt connected and fixed through the connecting buckle has a certain free adjusting range, even if the body of the user moves by a large amplitude, the waistband or the cloth belt cannot apply a tightening force to the user, and thus the good experience feeling of the user is improved. In addition, in the using process, compared with a structure of a fixed inner connecting rod 112, the slidable inner connecting rod 112 can be automatically tensioned to have an anti-skid effect on the waistband or the cloth belt.

Specifically, flanges 126 are arranged on two sides of the sliding frame 12, and guide grooves 223 corresponding to the flanges 126 are arranged on two sides of the sliding groove 22. The guide grooves 223 can slide in the sliding groove 22 through the flanges 126, guide slopes can be arranged at entrances of the guide grooves 223, thus the male connecting piece 10 and the female connecting piece 20 can be clamped through the clamping part 311 and then tightly connected together, and as a result, the connecting stability of the connecting buckle is improved.

A chamfer 127 can be arranged on the side, close to the female connecting piece 20, of the sliding frame 12, a blocking table 224 corresponding to the chamfer 127 is arranged on the side, close to the male connecting piece 10, of the sliding groove 22, and thus a phenomenon that the sliding frame 12 slides to exceed the range of the sliding groove 22, and consequently, the male connecting piece 10 and the female connecting piece 20 cannot be clamped and connected is avoided.

A convex strip 225 can be arranged on the sliding groove 22, the height of the convex strip 225 is gradually increased from an entrance of the sliding groove 22, and thus the stability of the connecting buckle after connection is improved.

Specifically, the rotating shaft 32 includes clamping ends 322 at two ends and a fast-mounting spring 321 arranged between the two clamping ends 322. When the buckling piece 31 and the sliding frame 12 are fixed through the rotating shaft 32, one clamping end 322 is connected to one side of the buckling piece 31 and one side of the sliding frame 12, the fast-mounting spring 321 and another clamping end 322 are sequentially placed in the buckling piece 31, after the another clamping end 322 is pressed, the other side of the buckling piece 31 and the other side of the sliding frame 12 can be fast connected, and thus the assembling and manufacturing efficiency of the connecting buckle can be improved.

Specifically, an upper spring fixing groove 313 in match with the upward supporting spring 33 is arranged on the lower end of the buckling piece 31, a lower spring fixing groove 124 in match with the upward supporting spring 33 is arranged on the sliding frame 12, and the upper spring fixing groove 313 and the lower spring fixing groove 124 are correspondingly arranged. An upper fixing base 314 in match with the upward supporting spring 33 is arranged in the upper spring fixing groove 313, and a lower fixing base 125 in match with the upward supporting spring 33 is arranged in the lower spring fixing groove 124. The upward supporting spring 33 can be conveniently mounted through the upper spring fixing groove 313 and the lower spring fixing groove 124, the upward supporting spring 33 is prevented from disengaging from the upper spring fixing groove 313 and the lower spring fixing groove 124 through the upper fixing base 314 and the lower fixing base 125, and thus continuous use of the connecting buckle is guaranteed.

Specifically, anti-skid lines 341*b* are arranged at the top end of the shifting block 341. A phenomenon that the shifting block 341 is shifted ineffectively is avoided through the anti-skid lines 341*b*, and the effectiveness of opening or closing of the pressure stopping apparatus 34 is guaranteed.

In conclusion, according to this application, the connecting buckle includes the male connecting piece 10, the female connecting piece 20 and the buckling apparatus 30, the male connecting rod 11 is arranged at one end of the male connecting piece 10, the sliding frame 12 is arranged at the other end of the male connecting piece 11, and rotating holes 121 are arranged on the two sides of the sliding frame 12; the female connecting rod 21 is arranged at one end of the female connecting piece 20, the sliding groove 22 corresponding to the sliding frame 12 is arranged at the other end of the female connecting piece 20, and the buckling hole 221 is arranged on the sliding groove 22; the buckling apparatus 30 includes the buckling piece 31 arranged on the sliding frame 12, the buckling piece 31 is arranged in match with the sliding frame 12, the rotating shaft 32 is arranged on the buckling piece 31, the rotating shaft 32 and the rotating holes 121 are correspondingly arranged, the clamping part 311 corresponding to the buckling hole 221 is arranged at one end of the buckling piece 31, the upward supporting spring 33 is arranged between the other end of the buckling piece 31 and the sliding frame 12, and the pressure stopping apparatus 34 is also arranged on the buckling apparatus 30. The connecting buckle with the safety switch has the advantages that the structure is simple, accidental loosening of the connecting buckle is completely avoided, and the universality is wide.

It is to be understood that for those ordinary skilled in the art, improvements or transformations can be made according to the above description, and all these improvements and transformations should fall within the protection scope of the claims attached to this application.

What is claimed is:

1. A connecting buckle with a safety switch, comprising a male connecting piece, a female connecting piece and a buckling apparatus, wherein a male connecting rod is arranged at one end of the male connecting piece, a sliding frame is arranged at the other end of the male connecting piece, and rotating holes are arranged on two sides of the sliding frame;

a female connecting rod is arranged at one end of the female connecting piece, a sliding groove configured to accommodate the sliding frame is arranged on the other end of the female connecting piece, and a buckling hole is arranged on the sliding groove;

the buckling apparatus comprises a buckling piece arranged on the sliding frame and configured to be accommodatable in the sliding frame, a convex ring is arranged in the middle of the buckling piece, an inner hole of the convex ring is configured to be aligned with the rotating holes, a rotating shaft is arranged in the convex ring, two ends of the rotating shaft are arranged to be fitted into the rotating holes, a clamping part configured to be fitted into the buckling hole is arranged at one end of the buckling piece, an upward supporting spring is arranged between the other end of the buckling piece and the sliding frame, and a strip-shaped shifting slotted hole is arranged at one end, close to the upward supporting spring, of the buckling piece;

a pressure stopping apparatus is also arranged on the buckling apparatus, and the pressure stopping apparatus comprises a shifting block arranged on the buckling piece, a shifting rod configured to be fitted with the shifting slotted hole is arranged at the lower end of the shifting block, a pressing block is arranged at the lower end of the shifting rod, and a pressure stopping convex block that opposes the pressing block is arranged on the sliding frame.

2. The connecting buckle with a safety switch according to claim 1, wherein a convex hook mated with the clamping part is arranged in the sliding groove, and the convex hook is arranged on the side, away from the female connecting rod, of the buckling hole.

3. The connecting buckle with a safety switch according to claim 1, wherein a stop block is arranged on the inner side, close to the clamping part, of the sliding frame, and the stop block is arranged below the buckling piece.

4. The connecting buckle with a safety switch according to claim 1, wherein the distance between the upward supporting spring and the rotating shaft is less than the distance between the clamping part and the rotating shaft.

5. The connecting buckle with a safety switch according to claim 1, wherein the male connecting rod comprises an outer connecting rod and an inner connecting rod which are arranged in parallel, movable grooves perpendicular to the inner connecting rod are arranged on two sides of the male connecting piece, and two ends of the inner connecting rod are arranged to fit into the movable grooves.

6. The connecting buckle with a safety switch according to claim 1, wherein flanges are arranged on two sides of the sliding frame, and guide grooves configured to accommodate the flanges are arranged on two sides of the sliding groove.

7. The connecting buckle with a safety switch according to claim 1, wherein the rotating shaft comprises clamping ends at two ends and a fast-mounting spring arranged between the two clamping ends.

8. The connecting buckle with a safety switch according to claim 1, wherein an upper spring fixing groove in match-fitted with the upward supporting spring is arranged at the lower end of the buckling piece, and a lower spring fixing groove fitted with the upward supporting spring is arranged on the sliding frame.

9. The connecting buckle with a safety switch according to claim 8, wherein an upper fixing base coupled with the upward supporting spring is arranged in the upper spring fixing groove, and a lower fixing base coupled with the upward supporting spring is arranged in the lower spring fixing groove.

10. The connecting buckle with a safety switch according to claim 1, wherein anti-skid lines are arranged at the top end of the shifting block.

* * * * *